US007290689B2

(12) United States Patent
Oxley

(10) Patent No.: US 7,290,689 B2
(45) Date of Patent: Nov. 6, 2007

(54) HORIZONTAL STRING SUPPORTING BOW HOLDERS

(76) Inventor: Randy Oxley, 1511 Greencastle Ave. NW., Swisher, IA (US) 52338

( * ) Notice: Subject to any disclaimer, the term of this patent is extended or adjusted under 35 U.S.C. 154(b) by 1213 days.

(21) Appl. No.: 09/731,437

(22) Filed: Dec. 6, 2000

(65) Prior Publication Data

US 2002/0066759 A1 Jun. 6, 2002

(51) Int. Cl.
*A45F 5/00* (2006.01)

(52) U.S. Cl. ..... 224/270; 224/916

(58) Field of Classification Search ..... 224/270, 224/200, 650, 916
See application file for complete search history.

(56) References Cited

U.S. PATENT DOCUMENTS

| | | | | | |
|---|---|---|---|---|---|
| 4,121,743 | A | * | 10/1978 | Burton | 124/88 |
| D258,550 | S | * | 3/1981 | Strauss | D3/228 |
| 4,377,270 | A | | 3/1983 | Kolongowski | |
| 4,645,104 | A | * | 2/1987 | Vokaty | 224/673 |
| 4,729,363 | A | | 3/1988 | Skyba | |
| 4,896,806 | A | * | 1/1990 | Sanchez, Jr. | 224/200 |
| 4,936,415 | A | | 6/1990 | Williams | |
| 5,111,800 | A | | 5/1992 | Reynolds | |
| 5,193,725 | A | * | 3/1993 | Radocy | 224/197 |
| 5,248,072 | A | * | 9/1993 | Jones | 224/247 |
| 5,377,657 | A | | 1/1995 | Foster et al. | |
| 5,697,537 | A | | 12/1997 | Bowlsby | |
| 5,711,467 | A | | 1/1998 | Brown, Sr. | |
| 5,775,658 | A | | 7/1998 | Englehardt | |
| 5,967,475 | A | | 10/1999 | Johnson | |
| 6,056,240 | A | | 5/2000 | Gorsuch | |
| 6,199,733 | B1 | * | 3/2001 | Reynolds, III | 224/269 |

FOREIGN PATENT DOCUMENTS

| | | | | |
|---|---|---|---|---|
| WO | WO91/13568 | * | 9/1991 | 224/650 |

OTHER PUBLICATIONS

Vertical Bowholder, www.verticalbowholder.com, "Vertical Bowholder—Hands-Free Carrying Of Your Bow".

* cited by examiner

*Primary Examiner*—Stephen K. Cronin
(74) *Attorney, Agent, or Firm*—James C. Nemmers

(57) ABSTRACT

The present invention is an improved bow holder. An engagement member is provided to connect the holder with a hunter or a hunter's apparel or equipment. A spacing member extends outwardly and downwardly therefrom to a support member. The support member forms a generally open-topped support structure such as a trough or arms located below a hunter's waist to suspend a bow by supporting a generally taut bow string, thus allowing the bow handle to rest generally at a height near the hunter's free-hanging and naturally resting hand.

26 Claims, 3 Drawing Sheets

HORIZONTAL STRING SUPPORTING BOW HOLDERS

BACKGROUND OF THE INVENTION

Many hunters, depending on preference or season, use a bow and arrow rather than guns of various types to hunt game such as deer, turkey and other prey. In fact, bow hunting is a popular sport for which a wide variety of equipment has been developed including highly refined bows and tree stands. Typically, bows used by recreational or professional hunters are compound bows that demand the application of many pounds of pressure to draw the string rearward and this force is applied through the assistance of the mechanical advantage afforded by pulleys. The addition of hardware such as pulleys, which must be of rugged and durable construction, to an already strong bow frame necessarily adds to the weight of the bow. As a result modern bows, although in many instances lighter than earlier models, are still heavy.

In hunting, for example deer hunting, it is also common for the hunter to spend large periods of time in a relatively small tree stand. From such a vantage point, the hunter may view an open area of field or forest and enjoy a clear shooting path in the event that prey emerges from brush and is observed within shooting range. When a hunter waits for prey, there is no comfortable means to hold the bow in a ready position for a long period of time without experiencing discomfort, cramping, or muscle fatigue. Whether the hunter is in a tree stand, in some other waiting position, or merely waiting on the ground, it is important to wait without movement or to minimize motion and minimize the number of steps required between spotting a target and releasing an arrow at the target. The necessity to eliminate motion relates not only to the need to act quickly in the event prey is spotted, but the need to minimize the likelihood that the hunter will create noise and scare the target back into the brush.

If, for example, a bow is allowed to rest on a seat beside a hunter or at the hunter's feet, then the hunter, upon observing prey, must first bend or otherwise move to reach the bow, lift the bow, turn the bow to be properly aligned for the release of an arrow, draw the bow, and release the arrow. Of course, each of these steps permits the creation of sound or observable motion that may alarm the prey or otherwise provide notice of the hunter's presence and send the prey running out of range.

Numerous prior art bow rests or stands exist to aid hunters in the support of their bows as they await prey. Of these devices, it appears that the majority relate to means for attaching a bow to a tree stand, to a tree, or to an object fixed in the ground. Examples of bow holders adapted to allow a hunter in a tree stand to rest a bow include U.S. Pat. No. 6,059,240 issued May 9, 2000, to Gorsuch (the '240 patent) in which a bow is suspended in a vertical position in front of a tree stand from a hanging arm affixed to the tree above the stand, or from a support bracket positioned near a base of the tree stand. The invention of the '240 patent provides a means for relieving the strain otherwise associated with holding a bow in a ready position, however, the hunter's view is necessarily obstructed through placement of the bow in a vertical position in front of the hunter. Further, depending on the degree to which a hunter has shifted position on the tree stand, substantial bodily movement may be required to grasp the bow when prey appears.

U.S. Pat. No. 5,775,658 issued Jul. 7, 1998, to Englehardt (the '658 patent) discloses a bow holder that may be attached to a tree stand or other hunting structure and which includes arms disposed to hold a bow by compressive force as selected arms are positioned behind the bow and a separate arm is pressed against the opposite side of the bow (see, e.g., FIG. 8 therein). Although the invention of the '658 patent includes the advantage of securing the resting bow between arms or "grips," this same feature creates the need for an additional step in the move from a resting position to the release of an arrow, i.e. the release of the bow from the grips or compressive arms of the stand.

U.S. Pat. No. 5,967,475 issued Oct. 19, 1999, to Johnson (the '475 patent) discloses a simple device that includes an extendible arm, a means for attaching such arm to a tree, and a bow supporting tip that may be rotated about the end of the extended arm to allow positioning of the bow at a desired location relative to the arm. Like the invention of the '240 patent, the invention of the '475 patent is adapted for attachment to a fixed surface and does not move with the hunter as the hunter may change position.

U.S. Pat. No. 5,377,657 issued Jan. 3, 1995, to Foster et al. (the '657 patent) discloses a bow holder adapted for attachment to the top surface a tree stand's base. The invention of the '657 patent discloses a saddle-like base having curved arms that extend upwardly therefrom and which double-back to end in upwardly facing hooks or "Ushaped" ends that are adapted to support a bow end. Again, by placing the bow in the upright position, visibility may be obscured. Further, the fixed base determines placement of the resting bow and, as with the other fixed position inventions, may demand substantial movement or shifting on the part of the hunter at the time that prey is observed.

Additional bow holders for use in combination with a tree stand or other support surface are disclosed in U.S. Pat. No. 4,377,270 issued Mar. 22, 1983, to Kolongowski (the '270 patent), U.S. Pat. No. 4,936,415 issued Jun. 26, 1990, to Williams (the '415 patent), and U.S. Pat. No. 4,729,363 issued Mar. 8, 1988, to Skyba (the '363 patent). These holders, like all of the holders disclosed above, relate to a means for supporting a bow on a surface or tree stand. They do not disclose a means for supporting a bow that is adapted to allow movement of the bow with the hunter, as the hunter may shift directions within the stand, or as the hunter may travel to and from the stand.

U.S. Pat. No. 5,111,800, issued May 12, 1992 to Reynolds (the '800 patent) discloses a bow support structure that may be used in the absence of a tree, tree stand, hunting structure or other surface to support a bow or a holder. The invention of the '800 patent includes a spiked end for insertion into the earth to create, for the ground-based bow hunter, an object that may serve as a support structure for a resting bow.

The prior art also includes U.S. Pat. No. 5,711,467 issued Jan. 27, 1998 to Brown, Sr. (the '467 patent) and U.S. Pat. No. 5,697,537 issued Dec. 16, 1997 to Bowlsby (the '537 patent). Both of these patents disclose inventions with the further object of providing a means for supporting a bow at or near a hunter's side, as through attachment to a belt. The invention of the '467 patent is a "Vertical Bow Holder Device" and it is comprised of rod-like or tubular members formed into belt engaging loops combined with an upper and a lower bow supporting hook. These hooks are adapted to hold a bow vertically in cooperation with the contours of a handle portion of a bow (as illustrated in FIG. 5 thereto). The '537 patent does not disclose or suggest the use of a holder that would place a bow in a horizontal position at a location on the user's body where the bow is in general alignment with the natural resting position of a hunter's relaxed and free-hanging bow-holding hand. Further, the '467 patent does not disclose or suggest a bow supporting holder wherein the bow is suspended by its strings. Rather, the disclosure of the '467 patent is specifically directed towards and adapted for use as a vertical bow holder that supports the bow by its central handle portion.

The '537 patent discloses a belt-mounted bow holder that is adapted to hold a bow in one of two selected angled positions, i.e. a forward tilting "ready" position for use when the hunter is awaiting prey, and a rearward tilting "transport" position for use when the hunter is traveling with the bow. The '537 patent discloses a stabilizer plate that is held against a user's hip or waist and which includes openings or slots to receive a hunter's belt. The '537 patent also discloses an engagement that comprises a tongue or plate for insertion behind a hunter's belt or waistband. A body extends outwardly, away from the hunter, and a body top surface is shown in five separate embodiments, and in the claims, to be located adjacent to the upper end of the stabilizer plate. The '537 patent discloses suspension of the bow by the bow or by the bow string. Notches are placed in the body top surface to cause the bow to rest in one of the two selected angled positions (ready or travel). In all embodiments, it is taught and disclosed to support the bow from a top surface that is at the same elevation, or higher than, the hunter's belt. Therefore, although the '537 patent discloses a bow holder that allows movement of the bow with the hunter, it provides for suspension of the bow from a surface at or above the hunter's belt.

When a typical hunter is kneeling or standing, the hunter's bow-holding hand will rest at a location generally near the midpoint between the hunter's waist and knee if the hand is allowed to hang naturally at the hunter's side. Therefore, the '537 patent fails to teach or suggest, and there remains a need for, a bow holder that provides for the suspension of a bow in a manner that will place the bow's central handle portion at a location generally near the midpoint between a kneeling or standing hunter's waist and knee. There also exists and remains a need for a bow holding device that provides for placement that promotes ease of manipulation of the bow when it is grasped and positioning of the bow sufficiently low on the hunter's body to minimize interference of the resting bow with arm movement.

SUMMARY OF THE INVENTION

The present invention is a bow holder that may hold a bow in a substantially horizontal position through suspension of the bow by its string from a trough or from arm supports that extend outwardly from a hunter's body at a location below the hunter's waist. In suspending the bow thusly, the handle or grip portion of the bow is effectively suspended at the general height where a hunter's relaxed bow-supporting hand will naturally rest. Further, when the bow is grasped from this position, it may simply be raised and turning of the bow is not required. Therefore, when the waiting hunter spots prey within range, the necessary movements are limited to grasping the bow, raising it without the need to turn it about, drawing the arrow and releasing. Importantly, placement of the bow below the hunter's waist removes the bow from the area where incidental contact and noise creation are likely. Further, placement of the bow below the hunter's waist removes the bow from a point of interference with the hunter's arm.

Numerous embodiments are disclosed herein including a simple embodiment that may be formed of a continuous piece of material such as molded plastic or a lightweight metal and which is adapted to be placed on the hunter's belt. Other embodiments include adjustable versions of the invention that allow the hunter to position the string supporting arms or trough at the necessary location relative to the hunter's body (to place the central bow handle at the desired location between the waist and knee) and at a desired distance out from the hunter's body. Another embodiment is disclosed as having an adjustable strap or straps (straps, cords, strings, ropes, harnesses, belts, elastic members, etc.) for attachment to various body parts (shoulder, waist, torso, thigh) to allow suspension of the bow below the waist and to allow load bearing to be shifted as desired. In yet another embodiment, a thigh-mountable embodiment is disclosed which provides for a pivotal trough or arms that allow the suspended bow to remain in a substantially horizontal position as the hunter may shift the position of his thigh.

DESCRIPTION OF THE PREFERRED EMBODIMENT OF THE INVENTION

The present invention is comprised of a supporting member 2, a spacing member 4, and an engagement member 6. The supporting member 2 is adapted to support a generally taut bow string that may be placed thereon and from which the stringed bow may hang downwardly. The engagement member 6 is adapted to engage a hunter's clothing, belt, body, or other equipment that may be worn on or carried with or near the body. The spacing member 4 is adapted to combine the engagement member and the spacing member so that the supporting member is held in a position generally below the engagement member and outwardly from the hunter's body.

Figure 1:
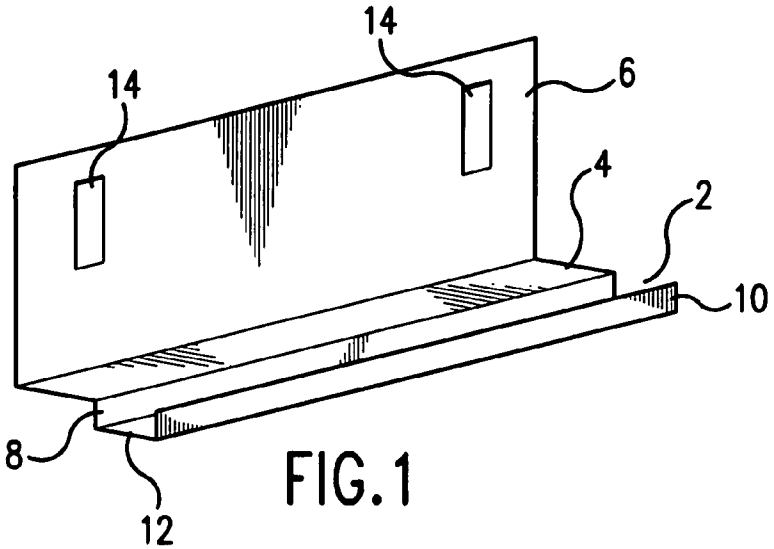
FIG. 1 is a perspective view of a first embodiment of the invention.

Embodiments of the present invention are described herein first with reference to FIG. 1. In FIG. 1, the supporting member 2 is illustrated as a trough that is formed of an inward section comprising a wall 8, an outward section comprising a wall 10, and bottom section, comprising a wall 12 disposed therebetween. In FIG. 1, the outward wall 10 is shorter than the inward wall 8 to facilitate the convenient and comfortable release of the bow string from the trough when a hunter grasps the bow handle (that is disposed below the trough) and lifts the bow upwardly. The invention may be practiced in an embodiment wherein a portion of the outward section 10 and/or a portion of the bottom section 12 is removed (See FIG. 7) to provide an opening through which a knocked arrow may pass. In this manner, the hunter awaiting prey may wait with a ready arrow to further eliminate steps required between spotting prey and releasing an arrow.

Figure 2:
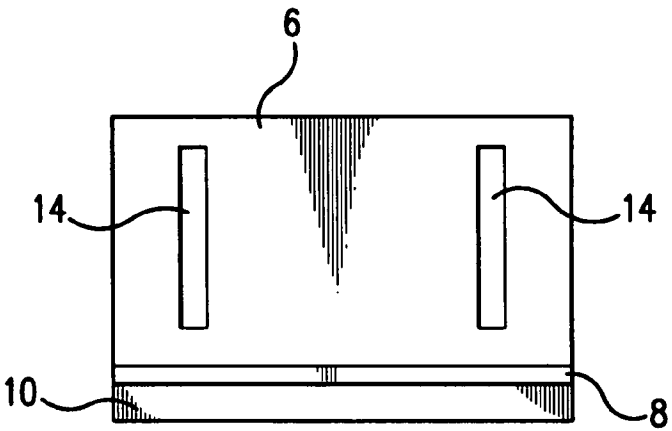
FIG. 2 is a front elevation view of the holder shown in FIG. 1.

FIG. 2 is a front elevation view of the embodiment illustrated in FIG. 1. In the embodiment of FIGS. 1 and 2, the spacing member 4 is a simple section of wall that extends from the support member to the engagement member 6, and the engagement member 6 is shown as a wall having two openings 14 formed therein which are adapted to receive a hunter's belt and to be held firmly against a hunter's side. In this manner, the engagement member wall serves as a belt plate in this first embodiment. The present invention in its various embodiments may also be practiced using an integral belt, harness, or other straps that may be provided as a part of the product. In such embodiments, the engagement member 6 may be integral with a belt or other holder affixing means rather than being adapted to receive or engage separate items such as belts, straps, etc.

Figure 3:
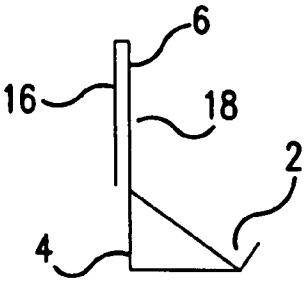
FIG. 3 is a side elevational view of a second embodiment of the invention.

FIG. 3 illustrates a second embodiment of the invention having a reinforced spacing member 4 to minimize the downward deflection of the support member 2 under the weight of a bow. This spacing member 4 shares a wall with the support member 2. This spacing member is a generally tubular member, but any type of reinforcement may be employed (flange and web, buttress arms, etc.). In FIG. 3, the support member 2 is formed as a "V" shaped trough. It is therefore shown that the present invention may be practiced using any convenient or desired upwardly open support member-whether shaped as a "V" (FIGS. 3,4), as a trough with right angles (FIGS. 1-2, 5-6), or as a curved body (FIG. 7). Finally, the engagement member 6 of this second embodiment comprises a generally vertical wall 18 and a second wall 16 generally parallel therewith and adapted to slide behind a hunter's belt or waistband.

Figure 4:
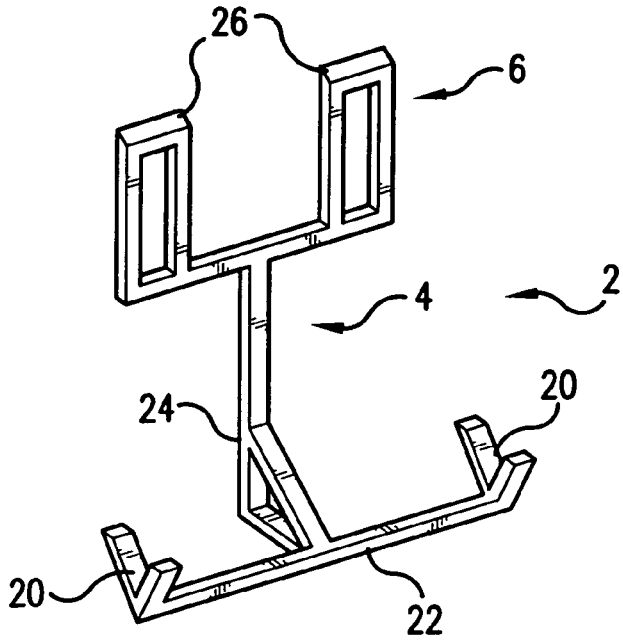
FIG. 4 is a perspective view of a simple, unitary, belt-mounted embodiment of the present invention employing support arms and a tubular structure.

FIG. 4 illustrates a third embodiment of the invention wherein tubular members are used in place of the walls shown in FIGS. 1-3. The supporting member 2 of the third embodiment comprises two parallel, upwardly concave "arms" mounted on an arm 16 that form two upwardly open structures 20. Further, the spacing member 4 is shown as a triangular rod-like or tubular member 24 and the engagement member 6 is shown as two looped, tubular sections 26. As illustrated in FIGS. 4 and 7, variations on the exemplary embodiments may include a combination of walls and arms as well as curved elements that eliminate sharp transitions between the engagement, spacing, and support functions. What is clear is that the holder must provide for a means to support a bow, extend this support at a selected distance from a hunter's body and below the hunter's waist and allow for the direct or indirect engagement of the holder with the hunter or the hunter's apparel.

Figure 5:
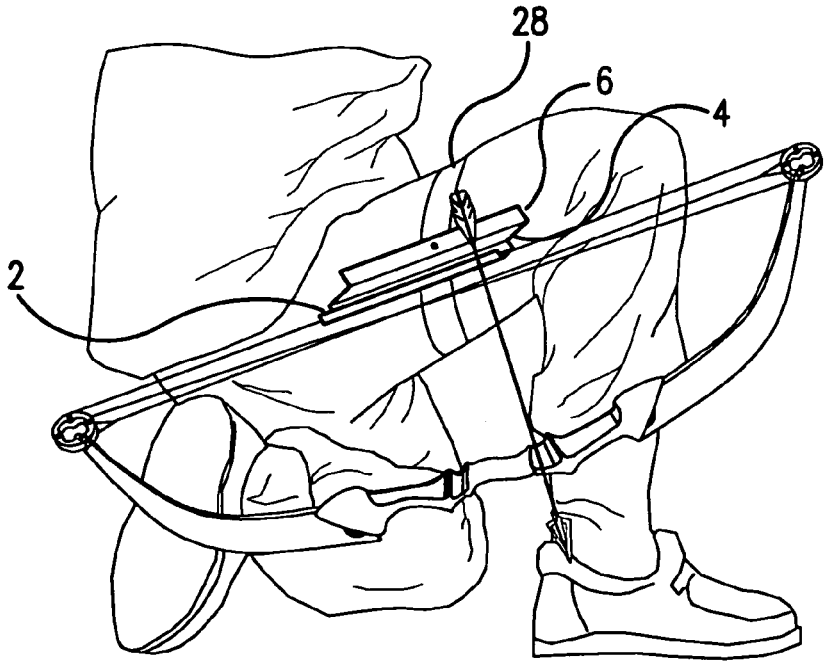
FIG. 5 is a perspective view of a thigh-mountable embodiment of the present invention having a pivotal string support surface.

FIG. 5 illustrates an embodiment of the present invention adapted to be attached to a hunter's thigh. In this embodiment, an adjustable or a fixed support member (preferably a "trough" or arms) may be provided depending on the application desired by the hunter. In a fixed application, an embodiment similar to those previously described is provided to allow a trough bottom wall or string support arm to lie generally in the same plane as the hunter's thigh. In this manner, the loops or previously described belt plate will necessarily be adapted to present a loop opening or plate opening positioned to receive straps that may be attached to the hunter's thigh.

A more complex version of the present invention for use on a hunter's thigh allows the support member to swing on a pivot mechanism so that the weight of the trough and the bow supported by its string from the trough cause the support member (such as string supporting arms or a trough bottom wall) to maintain a generally horizontal position as the hunter shifts or moves within a different sitting position, or between a sitting and a standing position. In this manner, the invention is adapted to support a hunter's bow in a generally horizontal position at a convenient height when suspended from the hunter's thigh. As used herein, the placement of the bow in a generally horizontal position is meant only to refer to the natural resting position of the bow when suspended by its string. This means of support is in contrast to a vertical support position wherein the bow is physically supported or wherein the bow hangs from the crotch of the string and bow combination. Herein, the string is supported at a position other than the points of connection of the string with the bow.

Figure 6:
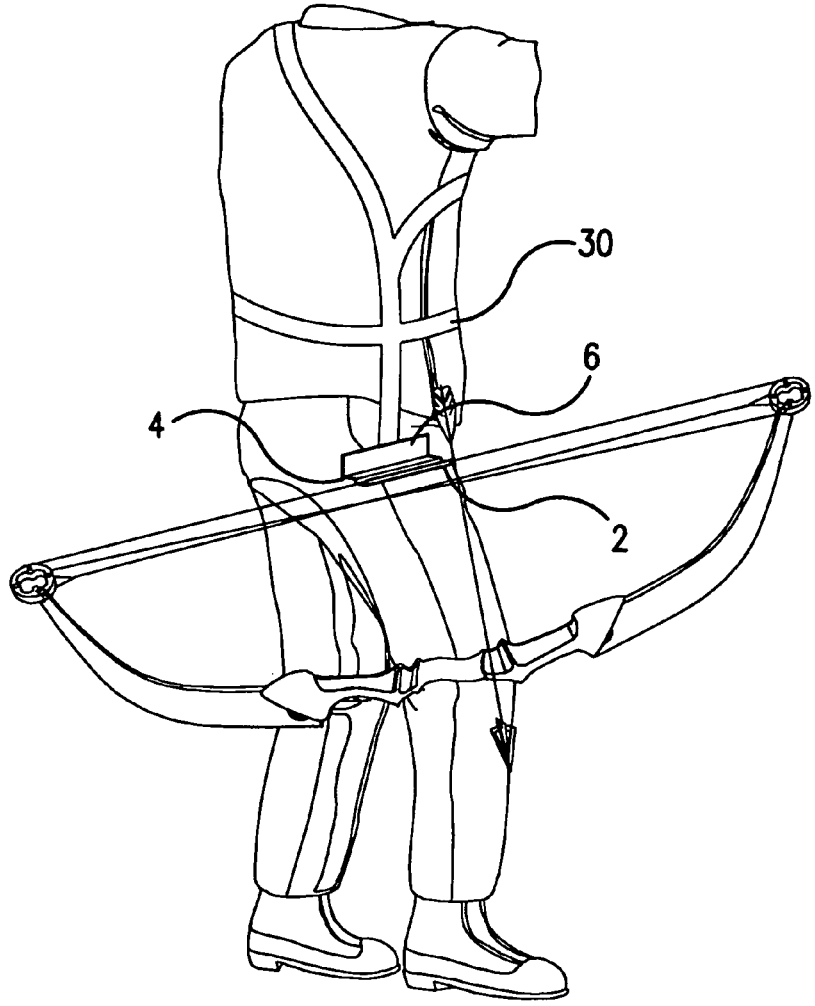
FIG. 6 is a perspective view of a harness-mounted version of the present invention.
Figure 7:
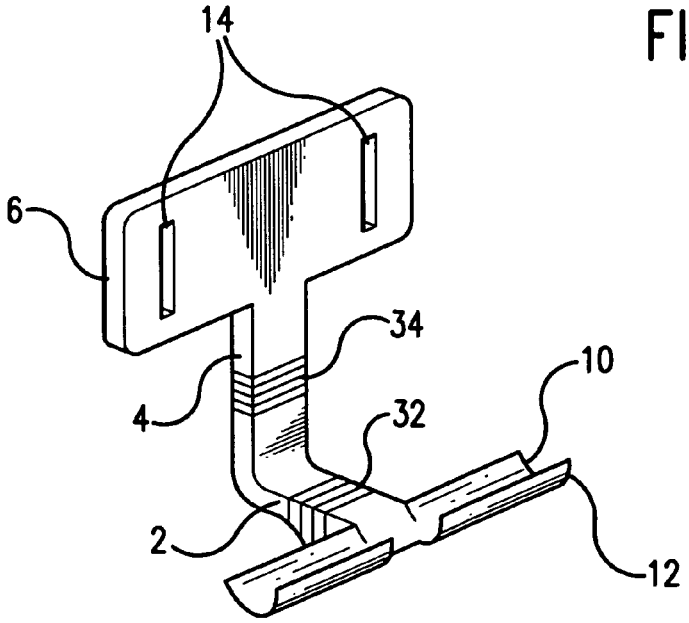
FIG. 7 is a perspective view of a two-way adjustable embodiment of the present invention.

FIG. 6 illustrates a harness-mounted embodiment of the present invention wherein the engagement member 6 is mounted on a generally vertically disposed strap rather than a generally horizontally disposed belt. A system of straps is arranged in a harness to support the holder and eliminate the need for belt attachment of the holder. FIG. 7 illustrates a generally rectangular reinforced spacing member 4 adapted to transfer load from the support member 2 to and against the hunter's thigh to prevent or minimize deflection of the support member 2 downwardly under the weight of the bow.

It is presently preferred to provide a spacing member 4 adapted to hold the string at a fixed, selected distance that is a convenient length as desired or as determined by hunters. Of course, the particular configuration of the support member may further space the string resting position from the hunter's body (e.g. the radius of a curved support member etc.). In slightly more complex versions of the present invention, the spacing member may be extendable rather than fixed and the hunter may adjust either or both the horizontal and/or the vertical distance between the support member and the extension member. The present invention encompasses the use of adjustable members in either or both the horizontal and vertical direction. FIG. 7 illustrates an embodiment wherein the holder includes both a vertically disposed adjustment section 34 and a horizontally disposed adjustment section 32. Such adjustable elements may be incorporated into the engagement member 6, the spacing member 4, or the support member 2 as desired. Preferred adjustment means include a nut and bolt in combination with a slot, expandable track connections, telescoping rod-like or tubular elements, or screw means. An accordion style expansion means is shown in FIG. 7. Of course, the particular type of expansion means used for the adjustable element may vary among any means convenient and appropriate for use under conditions given the expected load to borne, i.e. a compound bow.

Finally, it is preferred to select a non-slip or low-slip surface for use in the bottom region of the support body. This helps to keep the bow relatively stable within the support body and minimize or prevent sliding of the string within the support member.

Having thus described the invention in connection with the preferred embodiments thereof, it will be evident to those skilled in the art that various revisions can be made to the preferred embodiments described herein without departing from the spirit and scope of the invention. It is my intention, however, that all such revisions and modifications that are evident to those skilled in the art will be included within the scope of the following claims.

What is claimed is as follows:

1. A holder adapted to support a stringed bow in a generally horizontal position outwardly from a hunter's body at a position below the hunter's waist comprising:

a support member comprising an inward section and an outward section, said sections forming a generally upwardly concave surface;

a spacing member extending inwardly from the support member along a generally horizontal plane to position the support member a selected distance from the hunter's body; and an engagement member extending upwardly from said spacing member so as to be disposed generally above and inward from the support member.

2. The holder of claim 1 wherein; the support member comprises a wall.

3. The holder of claim 2 wherein the support member wall has an opening formed therein for accommodating an arrow.

4. The holder of claim 1 wherein; the support member comprises two or more support arms.

5. The holder of claim 1 wherein: the spacing member comprises a wall having an inward section and an outward section, said outward section being combined with the support member and said inward section being combined with the engagement member.

6. The holder of claim 1 wherein; the spacing member comprises an arm having an inward section. and an outward section, said outward section being connected to the support member and said inward section being connected to the engagement member.

7. The holder of claim 1 wherein: the engagement member comprises a wall having at least two openings formed therein.

8. The holder of claim 1 wherein; the engagement member comprises a wall having a outward section and an inward section combined to form an upwardly convex surface and wherein said engagement member outward section is combined with the spacing member.

9. The holder of claim 8 wherein; the upwardly convex surface is rounded.

10. The holder of claim 1 wherein; the engagement member comprises an arm.

11. The holder of claim 10 wherein; the engagement member air comprises a loop section having an opening formed therein.

12. The holder of claim 1 wherein; the engagement member comprises at least two arms, each of a said at least two arms comprising a loop section having an opening formed therein.

13. The holder of claim 1 wherein; the spacing member is pivotally combined with the engagement member.

14. The holder of claim 1 wherein; the spacing member is pivotally combined with the support member.

15. The holder of claim 1 wherein; the engagement member further comprises a strap.

16. The holder of claim 1 further comprising: a strap.

17. The holder of claim 1 wherein; the upwardly concave surface is rounded.

18. The holder of claim 1 wherein;

the support member further comprises a bottom side connected to the inward section and the outward section and extending therebetween.

19. The holder of claim 1 wherein;

the support member inward section is adjustable.

20. The holder of claim 1 wherein the spacing member comprises:

a reinforcement body.

21. The holder of claim 1 wherein the spacing member extends the support member outwardly from the hunter's body extending at least some distance past the engagement member.

22. The holder of claim 1 wherein the spacing member extends the support member outwardly from the hunter's body at least 2 centimeters.

23. The holder of claim 1 wherein the spacing member is adjustable in the horizontal direction which allows the support member to move horizontally relative to the hunter.

24. The holder of Claim 1 wherein the engagement member is adjustable in the vertical direction so that the support member moves vertically relative to the hunter.

25. The holder of claim 23 further comprising a screw for securing the adjustable spacing member in its proper position.

26. The holder of claim 24 further comprising a screw for securing the adjustable engagement member in us proper position.

* * * * *